US005211752A

United States Patent [19]

Allerton

[11] Patent Number: 5,211,752

[45] Date of Patent: May 18, 1993

[54] FLUID CONTAINMENT DEVICE

[75] Inventor: Girten O. Allerton, Mocksville, N.C.

[73] Assignee: Ingersoll-Rand Company, Woodcliff Lake, N.J.

[21] Appl. No.: 708,998

[22] Filed: May 31, 1991

[51] Int. Cl.[5] ..... B05B 11/00

[52] U.S. Cl. ..... 118/50; 118/309

[58] Field of Search ..... 118/50, 326, 309, DIG. 7, 118/634; 454/50, 53; 51/424, 425

[56] References Cited

U.S. PATENT DOCUMENTS

| | | | |
|---|---|---|---|
| H194 | 1/1987 | Oakley . | |
| 4,232,487 | 11/1980 | Brown | 51/425 |
| 4,333,277 | 6/1982 | Tasedan | 51/425 |
| 4,375,740 | 3/1983 | Brown | 51/425 |
| 4,539,932 | 9/1985 | Vecellio | 118/634 |
| 4,593,360 | 6/1986 | Cocks | 239/416 |
| 4,624,080 | 11/1986 | Jakobeson | 51/425 |
| 4,646,482 | 3/1987 | Chitjian | 51/424 |

*Primary Examiner*—W. Gary Jones
*Assistant Examiner*—Charles K. Friedman

[57] ABSTRACT

A nozzle spray containment apparatus contains a fluid being sprayed onto a work surface. A containment portion contains the spray being applied to the work surface. The spray is applied through an opening formed in the containment portion. An adapter is mounted in a portion of the opening to modify the opening, the adapter being provided for adapting engagement of the containment portion to variations in the work surface and for varying the opening to accommodate the variations in the work surface. A vacuum portion is in fluid communication with the containment portion whereby a negative pressure may be created in the containment portion. Various devices may be used to position a nozzle within the containment portion which applies the spray as desired.

21 Claims, 7 Drawing Sheets

FLUID CONTAINMENT DEVICE

BACKGROUND OF THE INVENTION

This invention relates generally to a fluid spraying process and more particularly to a containment device to contain and remove undesirable fumes left by the fluid spraying process.

Traditionally, such processes as sandblasting, abrasive blasting, fluid jet cutting and cleaning and spray painting have usually been accomplished in the open with little containment. Since these processes are often done in areas where people are located or machinery which might be damaged by the passage of the fluid is located. Recent Government Regulations restrict certain of these processes without containment structures containing the sprayed areas as well.

Containment of the fluid has been accomplished in the past by placing flexible tarps around the spray nozzle. However, each time a different location is being sprayed, a separate tarp support has to be constructed or devised. Substantial negative pressures which are desired to carry away the fluids or fumes cannot be applied to a flexible containment tarp.

Recent rigid containment structures have been constructed which permit application of negative pressures to flat surfaces only. Considering that it is desired to sandblast surfaces which are angled or curved in a single pass, this presents a major limitation.

The foregoing illustrates limitations known to exist in present containment structures for fluid jet equipment. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a nozzle spray containment apparatus for containing a fluid being sprayed onto a work surface. A containment portion contains the spray being applied to the work surface. The spray is applied through an opening formed in the containment portion. An adapter is mounted on the containment portion adjacent the opening for adapting engagement of the containment portion to the work surface for accommodating variations in the work surface.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
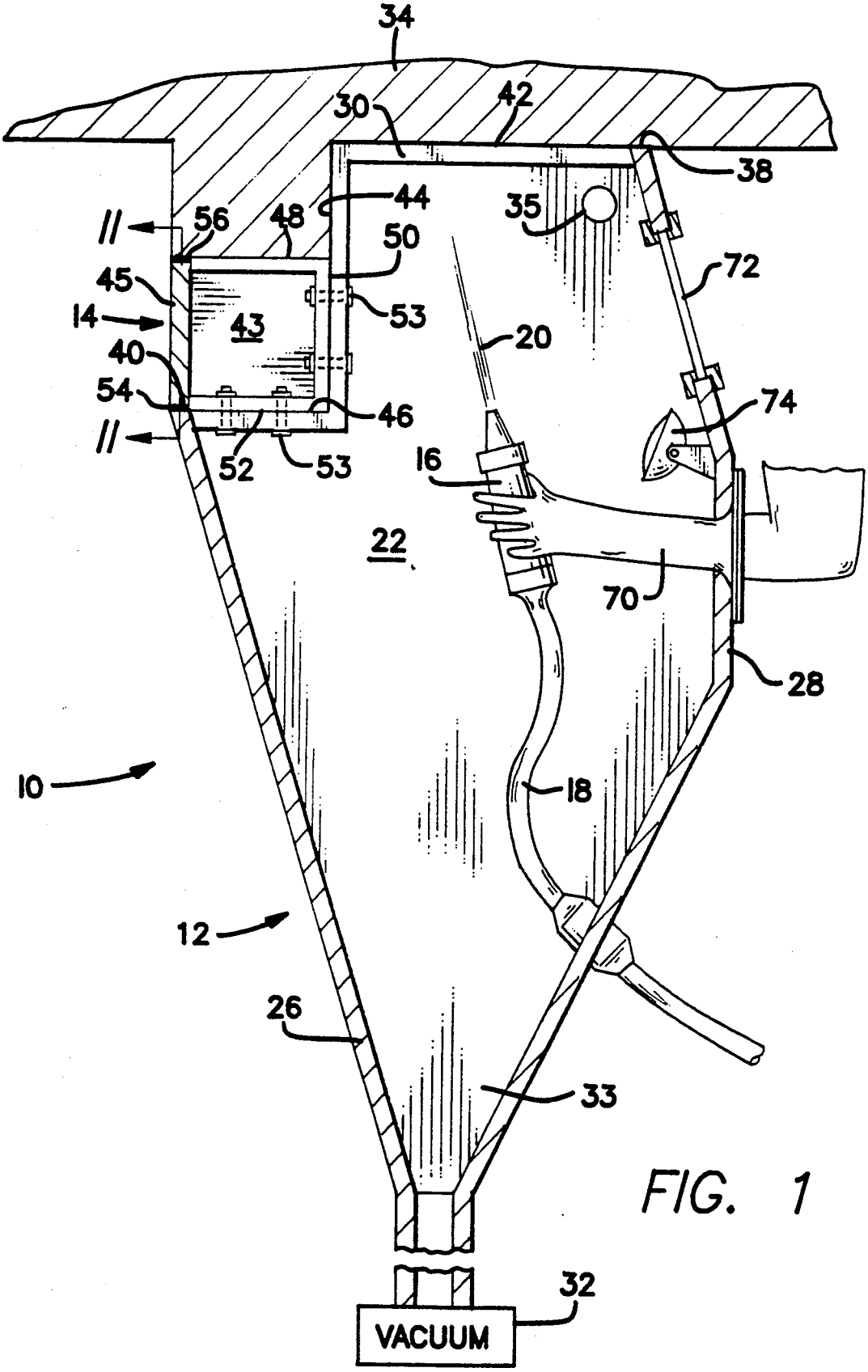
FIG. 1 is cross sectional view illustrating an embodiment of fluid jet containment portion and associated adapters of the present invention being applied to a shallow beam worksurface.
Figure 2:
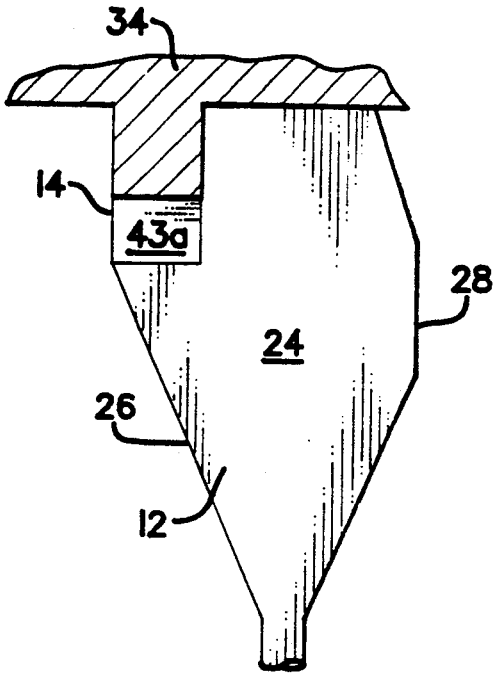
FIG. 2 is a side elevational view of the fluid jet containment portion and the associated adapter of FIG. 1.
Figure 3:
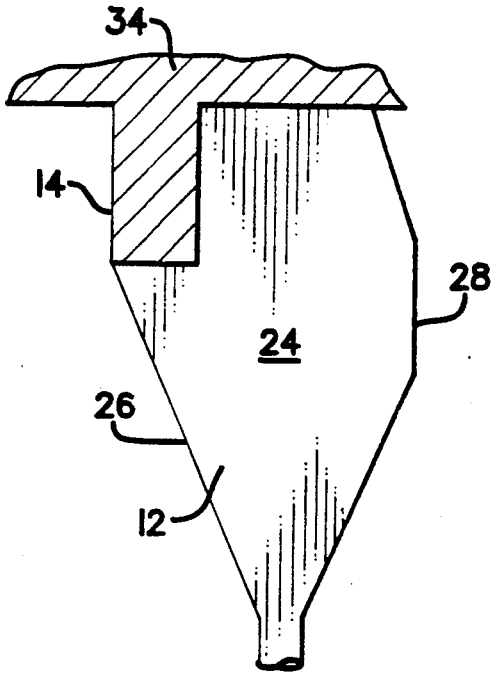
FIG. 3 is an elevational view of the fluid jet containment portion of FIG. 1, with no adapter, being applied to a box beam.
Figure 4:
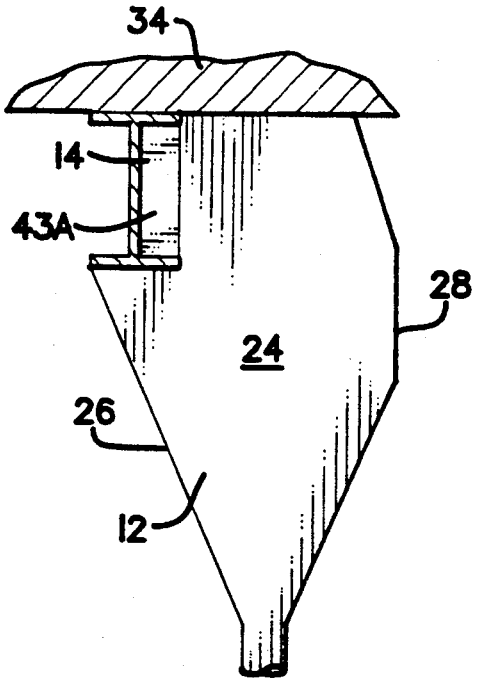
FIG. 4 is an elevational view of the fluid jet containment portion of FIG. 1, with an alternate embodiment of an adapter being applied to an I beam.
Figure 5:
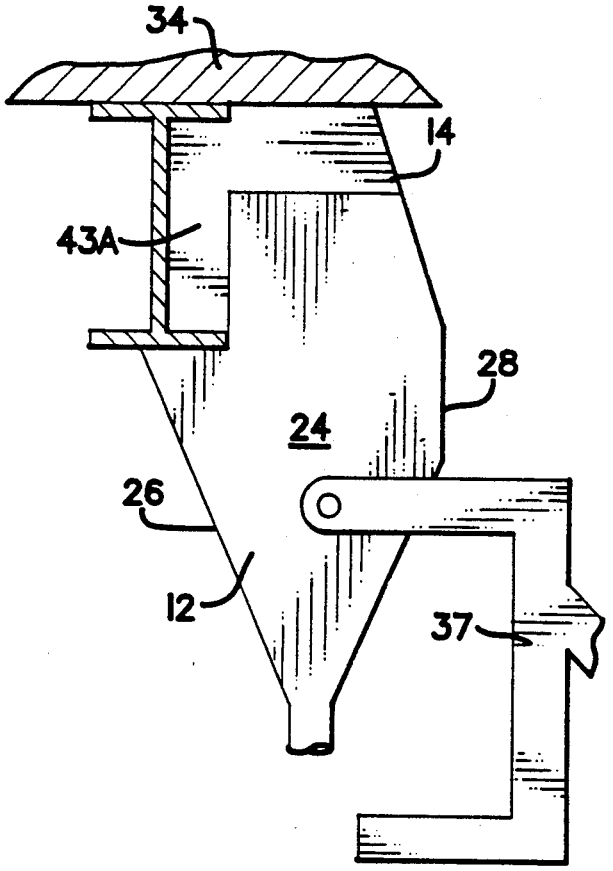
FIG. 5 is an elevational view of the fluid jet containment portion of FIG. 1, with a second alternate embodiment of an adapter being applied to a deep I beam.
Figure 6:
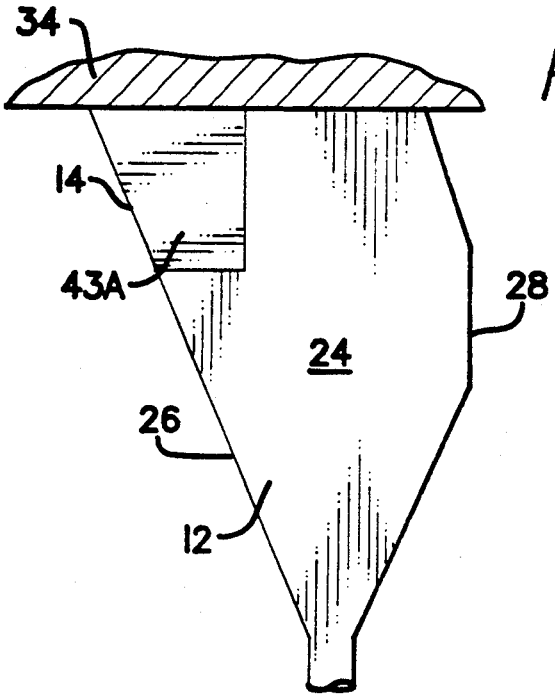
FIG. 6 is an elevational view of the fluid jet containment portion of FIG. 1, with a third alternate embodiment of an adapter being applied to the bottom side of a horizontal surface or a ceiling.
Figure 7:
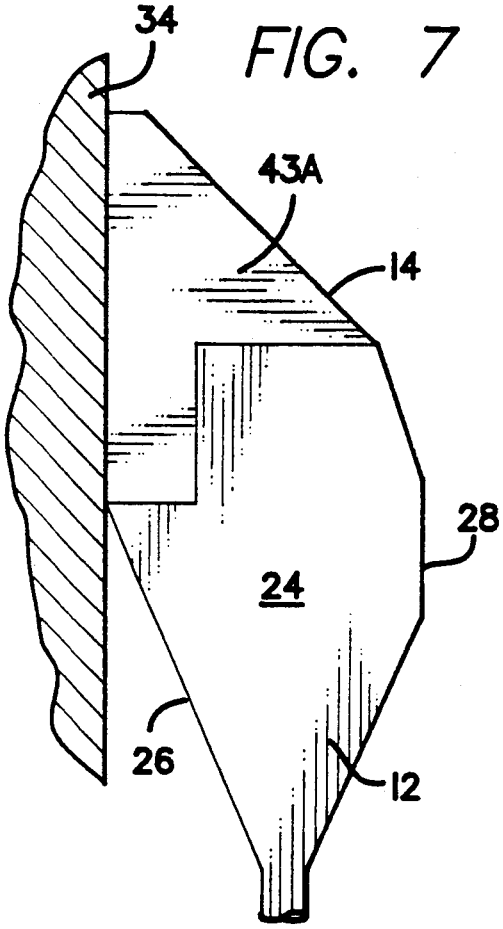
FIG. 7 is an elevational view of the fluid jet containment portion of FIG. 1, with a fourth alternate embodiment of an adapter being applied to a vertical wall or tank or ship hull.
Figure 8:
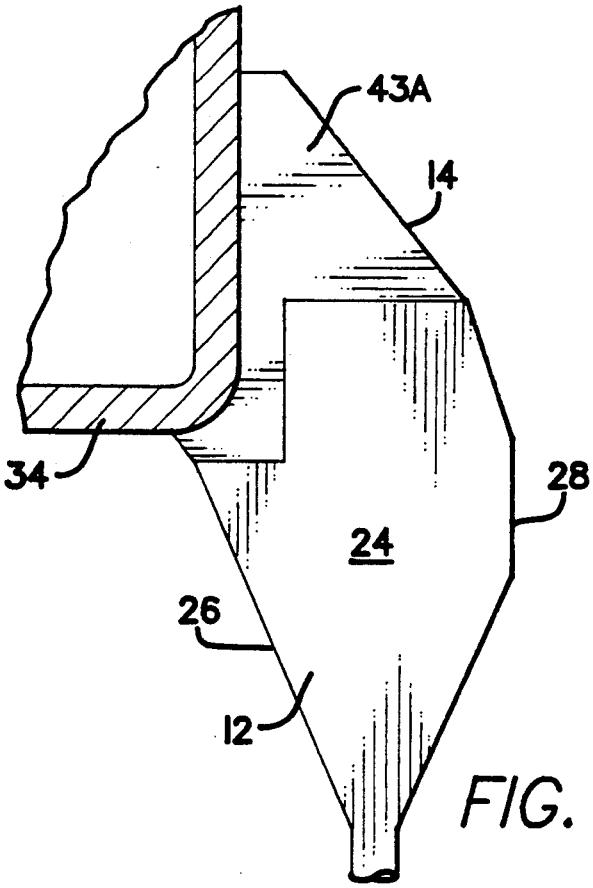
FIG. 8 is an elevational view of the fluid jet containment portion of FIG. 1, with a final alternate embodiment of an adapter being applied to a curved surface such as the bilge of a ship.

In this disclosure elements would perform identical functions are provided with identical reference characters.

A nozzle spray containment apparatus is illustrated generally as 10. The nozzle spray containment apparatus 10 includes a containment portion or means 12 and adapter means 14. A fluid jet nozzle 16 is contained within the containment portion 12. Hose 18 supplies fluid to the fluid jet nozzle 16 thereby producing a fluid jet 20. The fluid jet 20 is composed of material which is desired to separate from the atmosphere. Examples of fluid being sprayed which this invention applies to are abrasives in air used for sand or abrasive blasting, pure water or water with impurities to be used for waterjet cutting or cleaning, and paint spraying.

The containment portion 12 includes side walls 22, 24 a back wall 26 and a front wall 28. An opening 30 is formed in the containment portion 12 and is bounded by side walls 22, 24, the back wall 26 and front wall 28. A vacuum device 32 is in communication with a low portion 33 of the containment portion 12. The vacuum device acts to remove fluids supplied by the nozzle or materials removed by the fluids, and transport said fluids and materials to be filtered and/or collected. The lower portion 33 of the containment portion 12 is deeply inclined to assist in the removal of the fluid by the vacuum device 32.

A vent 35 is located in the containment portion remotely from where the fluid jet 20 is to be aimed. The area of the vent 35 and the power of the vacuum means 32 are designed to produce a vacuum within the containment means to restrict passage to fluid from within the containment means to atmosphere. The vent 35 is sufficiently large, and located at a location distant from the vacuum means 32, wherein the air flow from the vent 35 to the vacuum means 32 will limit excessive clouding of the air within the containment portion resulting from the impacting fluid jet 20. This air flow is vital so the operator will have a continual view of the work surface 34.

The nozzle spray containment apparatus 10 is designed primarily to permit application of the fluid jet 20 to the work surface 34 while restricting passage of material the fluid jet to atmosphere. It is highly desirable to apply one containment portion 12 to work surfaces having as many different configurations as possible. Therefore, adapter means 14 are affixed to the containment portion 12 as described below.

The adapter means 14 functions o modify a contour of the opening 30 and prevents fluid passage from between the containment portion 12 and the work surface 34 to atmosphere. As illustrated in FIG. 1 the opening 30 is bounded by sealed surface 38 of the front wall 28, sealed surface 40 of the back wall 20, contact surfaces 42, 44 and 46 of the side wall 22 and identical contact surfaces 42A, 44A, 46A of the other side wall 22, not illustrated (in this specification, any reference character referenced "A" is not illustrated in the drawings, but corresponds to side wall 24 as the base reference character relates to side wall 22).

In FIG. 1 the sealed surface 40 of the back wall 26 contact surfaces 46, 46A and lower portion of contact surfaces 44, 44A are spaced from the work surface 34. Therefore the adapter means 14 must be contoured to restrict fluid passage between the containment portion and atmosphere.

The adapter means 14 may include rear wall 45 and end walls 43, 43A (depending upon the configuration). A seal 54 of the rear wall 45 seals with sealing surface 40 of the back wall 26. Seal 56 of the rear wall 45 seals with the work surface 34. Sealing surfaces 48, 48A of the end walls 43, 43A, respectively, seal with work surface. Sealing surfaces 50, 50A seal with contact surface 44, 44A, respectively. Finally, sealing surfaces 52, 52A seal with contact surface 46 46A. Fasteners 53 connect sealing surfaces 52, 52A with contact surfaces 46, 46A and sealing surface 50, 50A with contact surface 44, 44A.

In this manner, the adapter means encompasses or forms a full enclosure between the opening 30 and the work surface 34. FIGS. 1 to 8 illustrate different possible configurations for adapter means which may be used apply an identical containment portion 12 to considerably different work surfaces 34. It is intended that the containment portion 12 illustrated may be applied to many different work surfaces 34 not illustrated.

A window 72 is formed on the front wall 28 whereby the operator may be able to see the application of the fluid jet 20 to the work surface 34. A light 74 is located within the containment portion 12. A frame 37 shown in FIG. 5 pivotally supports the containment portion 12. The operator may stand on a portion of the frame 3 while working.

One of the primary benefits of having an adapter of this type is, as illustrated in FIGS. 1-8, that a relatively permanent containment portion 12 may be applied to work surfaces not only having different contours but having, also having different planer orientations relative to the containment portion 12. Also the fluid jet nozzle 16 may be applied at different angles on a single work surface 34 having many different planar angles. It is implicit in this design that a mechanism is included to adjust and position the fluid jet nozzle 16 within the containment portion 12.

This may be accomplished, as illustrated in FIG. 1, by using glove portions 70 which extend through the front wall 28 (with the seal formed there between) whereby an operator may manually hold and aim the fluid jet nozzle.

Figure 9:
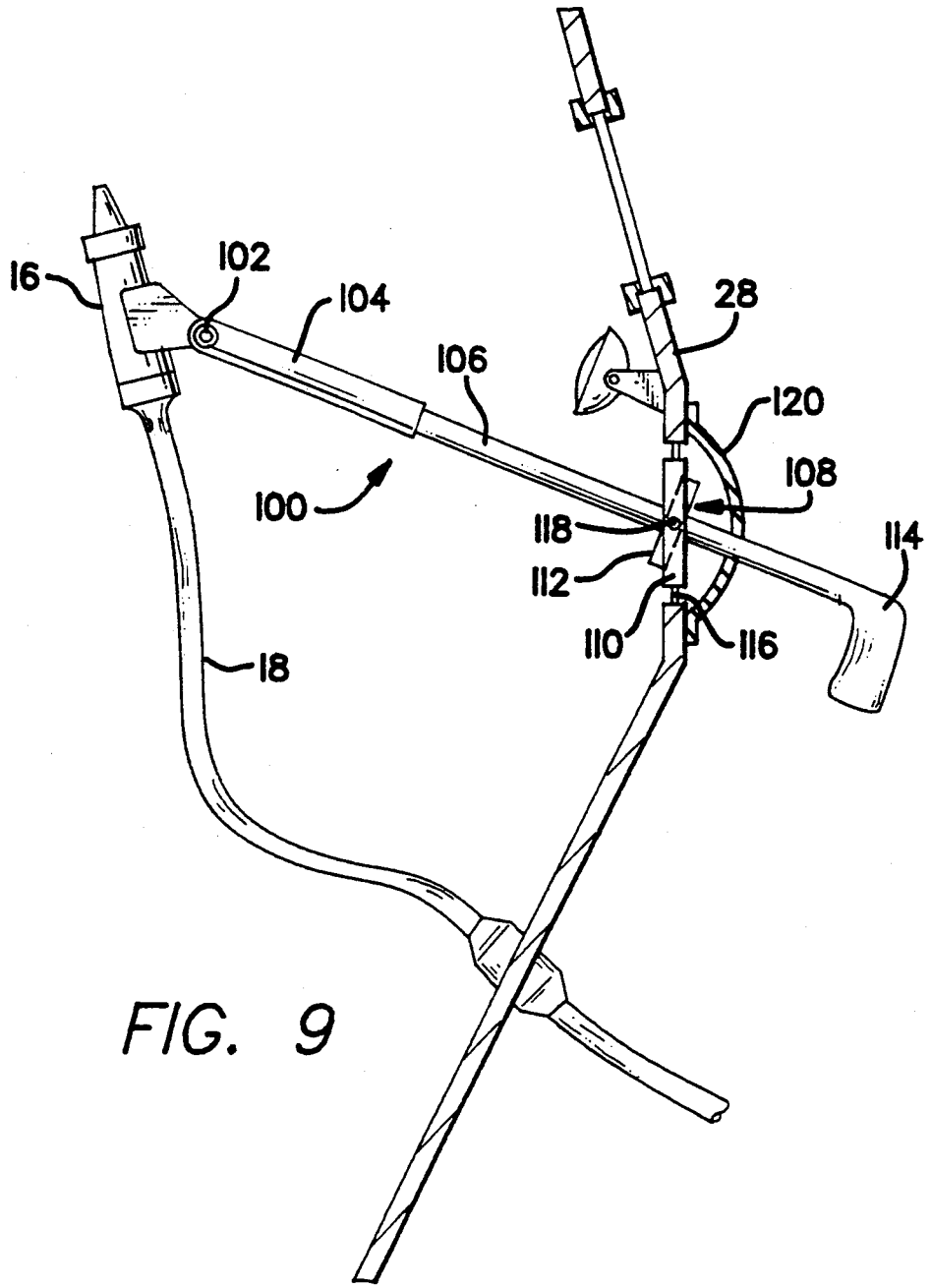
FIG. 9 is an elevational view of an alternate embodiment of a nozzle displacement and positioning device from that illustrated in FIG. 1.

An alternate configuration (see FIG. 9) permits accurate aiming and positioning of the fluid jet nozzle 16 within the containment portion 12 is. An arm member 100 is attached via pivot member 102 to the fluid jet nozzle 16 wherein the fluid jet nozzle ma be angularly adjusted relative to the arm member 100. The arm member 100 consists of a first arm portion 104 and second arm portion 106 which are axially extendable relative to each other. Many methods may be used to extend the second arm portion 106 relative to the first arm portion 104 such as hydraulics, pneumatics, screw translations actuators, or other well known methods in the prior art.

A universal connector or gimbal 108 affixes the arm member 100 to the front wall 28. The universal connector 108 includes an outer ring 110 and an inner ring 112. The second arm portion 106 extends through the inner ring 112 forming an operators handle 114. An operator can thereby position the second arm portion 106 by lateral forces applied to the operators handle 114. The operator's handle 114 is located on an opposite side of the universal connector 108 from axial forces applied to the first arm portion 114 whereby axial forces will be taken up by the universal connector 108 instead of the operator. Therefore, the effort exerted by the operator will go down significantly by use of a system such as this.

The universal connector 108 is constructed as follows. The outer ring 110 is pivoted on the first wall 28 by a first pivot 116. The inner ring 112 is pivotally attached to the outer ring 110 by a second pivot 118. An operator's seal 120 is connected between the first wall 18 and the operator's handle 114. Using this configuration, the fluid jet nozzle can be positioned at whatever point, and in which ever direction, within the containment portion 12 that is desired.

Figure 10:
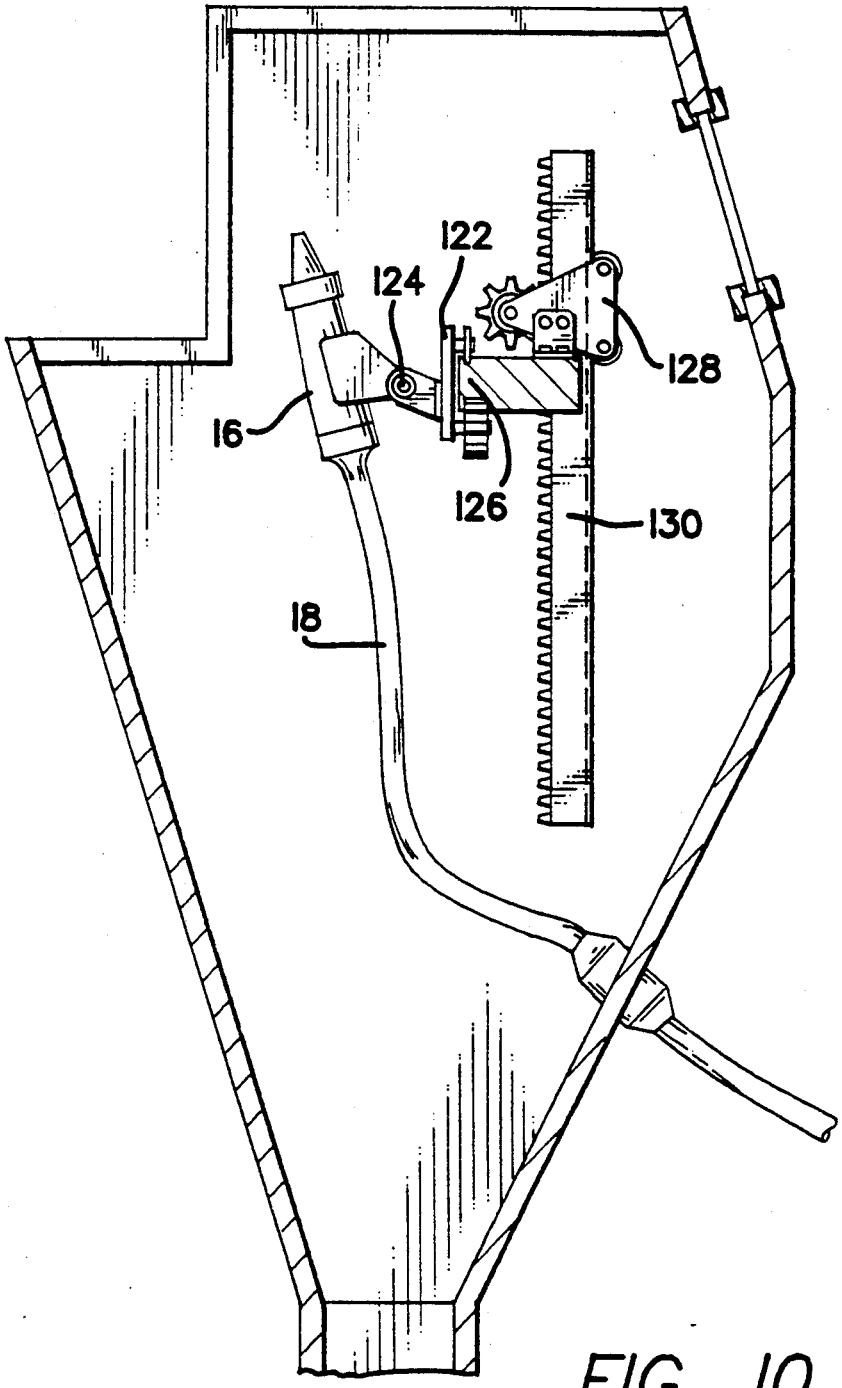
FIG. 10 is a partial cross sectional view of yet another alternate embodiment of a nozzle displacement and positioning device from that illustrated in FIG. 1.

In yet another alternate fluid jet nozzle 16 positioning configuration, illustrated in FIG. 10, the fluid jet nozzle 16 is pivotally affixed to a first carriage 122 via a pivot means 124. The first carriage 122 is axially translatable along a first track means 126. The first track means extends substantially between the side walls 22, 24. Affixed to the first track mean 126 adjacent each side wall 22, 24 are a plurality of second carriage means 128, 128A, respectively. A second carriage means 128 is axially translatable mounted to second track means 130, 130A, respectively. In this manner, the fluid jet nozzle 116 may be positioned anywhere within the containment portion 12 which lies along the plane of the second track means 130, 130A.

It's anticipated the first carriage may be operated on the first track means 126 (and the second carriage means 128, 128A may be operated on the second track means 130, 130A) by remote electrical control, hydraulic control, pneumatic control, or any other type of motion producing method which is presently well known in the art. Control of these motions may be by semi-automatic operator control of the carriages, or alternately the control of the motion may be fully automatic where on a computer or microprocessor, not shown, is programmed as is well known in the art.

Figure 11:
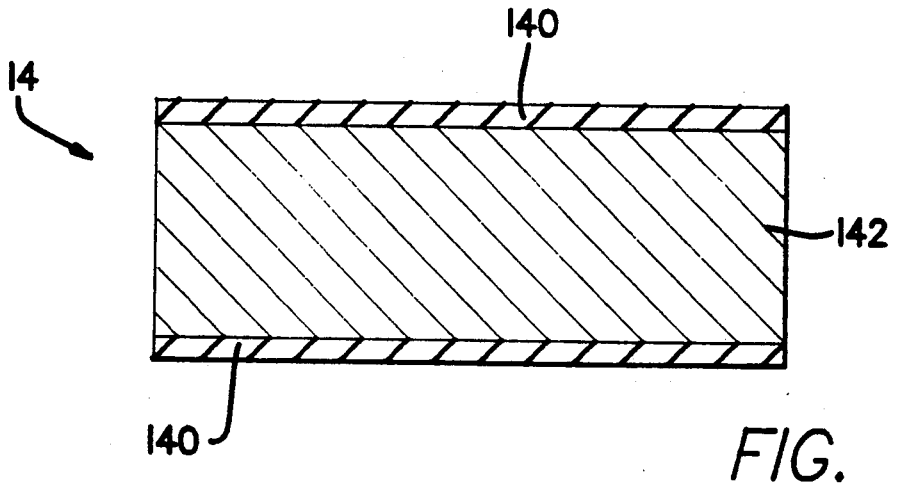
FIG. 11 is a cross sectional view a taken along sectional lined 11—11 of FIG. 1, illustrating one embodiment of the adapter of the present invention.

The adapter means 14 may be constructed as illustrated in FIG. 11 by forming a seal portion 140 about a rigid portion 142. The rigid portion will resist negative pressures may be produced within the containment portion 12.

Figure 12:
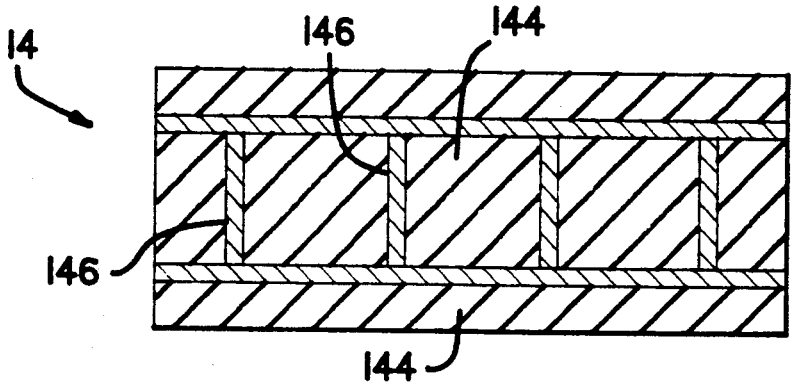
FIG. 12 is a cross sectional view illustrating an alternate embodiment of an adapter of the present invention.

In FIG. 12, the adapter means is formed from a flexible portion 144 and a rigid framework 146. The flexible material is chosen to provide a suitable seal with the work surface 34.

Figure 13:
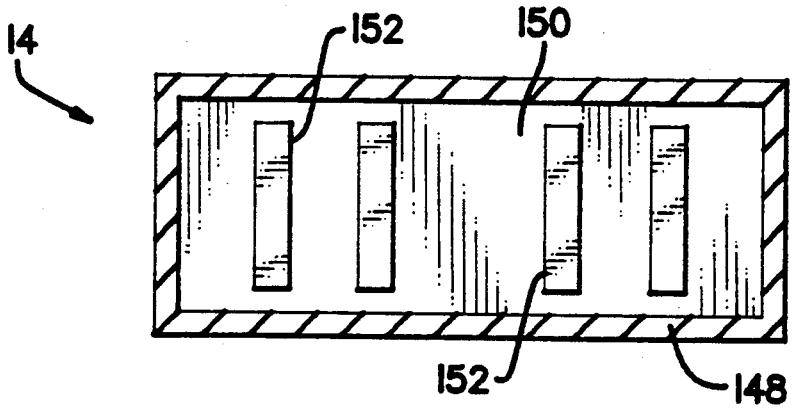
FIG. 13 is a cross sectional view illustrating yet another alternate embodiment of an adapter of the present invention.
Figure 14:
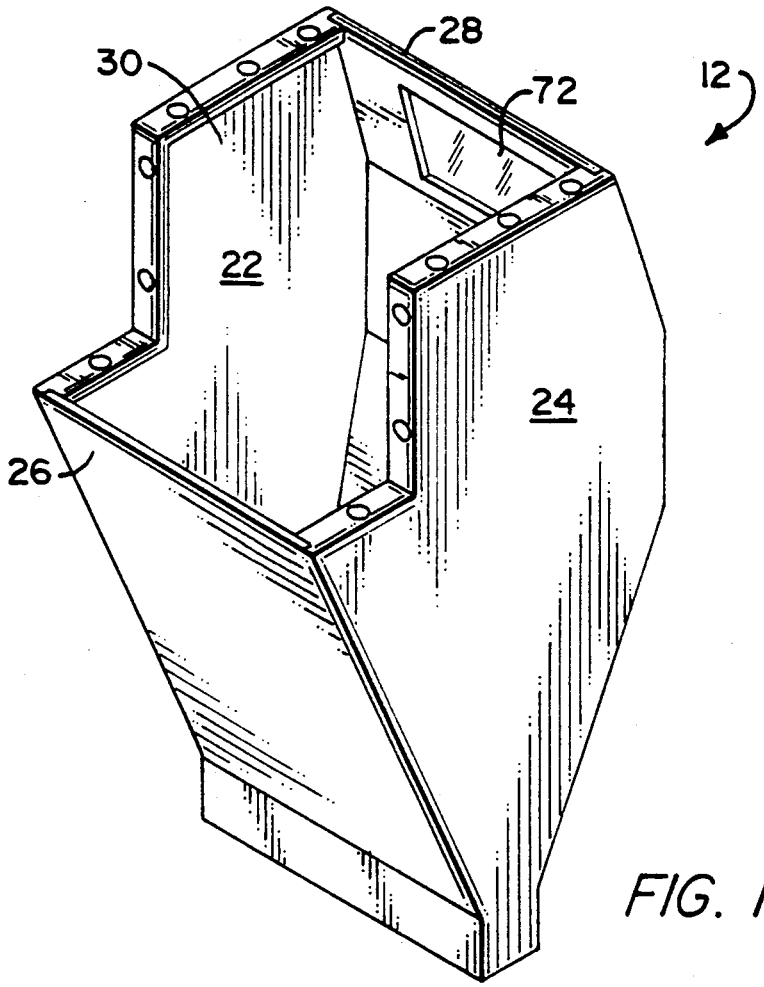
FIG. 14 is a perspective view of one embodiment of the containment portion of the present invention.

Finally, the adapter means 14 can be formed of an expansible bellow 148 with an interior pressure cavity 150 formed therein as illustrated in FIG. 13. Application of fluid pressure within the interior pressure cavity 150 biases the expansible bellow 148 into contact with work surface 34. The expansible bellow is constructed with flange portions 152 to resist the negative pressures produced within the containment portion 12.

While this invention has been illustrated and described in accordance with a preferred embodiment, it is recognized that the variations and changes may be made therein without departing from the invention as set forth in the claims.

Having described the invention, what is claimed is:

1. A nozzle spray containment apparatus, comprising:

containment means for containing sprayed material being applied from a nozzle to a work surface, the sprayed material being applied through an opening formed in a portion of the containment means;

one of a plurality of adapter means, being at least partially rigid, replacably connected to the containment means, forming said opening for adapting engagement of the containment means to said work surface, rigid portions of each adapter means having at least two non-planar configurations thereby permitting the nozzle spray containment apparatus to conform to work surfaces of different contours.

2. The apparatus as described in claim 1, wherein the containment means is rigid.

3. The apparatus as described in claim 1, wherein the nozzle means is freely movable within the containment means.

4. The apparatus as described in claim 1, wherein at least a portion of adapter means is flexible.

5. The apparatus as described in claim 1, further comprising:

a frame, the containment portion being displaceably mounted to the frame wherein the opening may be positioned relative to the work surface.

6. The apparatus as described in claim 1, wherein the adapter means may be applied to a work surface having a plurality of multi-planar surfaces which the adapter means and the containment means contacts.

7. The apparatus as described in claim 1, wherein negative pressure may be applied to the containment means.

8. The apparatus as described in claim 1, further comprising:

vacuum means in communication with the containment means for producing a negative pressure within the containment means.

9. The apparatus as described in claim 8, further comprising:

a vent portion located in the rigid containment means remotely from the vacuum means.

10. The apparatus as described in claim 8, wherein the vacuum means transports sprayed material from the containment means.

11. The apparatus as described in claim 1, further comprising:

glove portions passing through the containment means, wherein an operator located outside of the containment means may manually hold and position a nozzle which expels the spray.

12. The apparatus as described in claim 1, further comprising:

a remote mechanical actuator extending through the containment means, wherein an operator located externally of the containment means can position a nozzle which expels the sprayed material within the containment means.

13. The apparatus as described in claim 1, further comprising:

robotic means for positioning a nozzle which expels the sprayed material.

14. The apparatus as described in claim 1, further including a glove portion extending into the containment means for use by an operator.

15. The apparatus as described in claim 14, wherein the glove portion permits the operator to manipulate the nozzle within the containment means.

16. A nozzle spray containment apparatus, comprising:

containment means, being at least partially rigid, for containing sprayed material being applied from a nozzle to a work surface, the sprayed material being applied through an opening formed in a portion of the containment means;

one of a plurality of adapter means, being at least partially rigid, interchangeably mounted to the containment means adjacent the opening for adapting engagement of the containment means to said work surface for accommodating variations in the work surface, rigid portions of the adapter means having at least two non-planar configurations thereby permitting the nozzle spray containment apparatus to conform to work surfaces having different contours; and vacuum means in fluid communication with the rigid containment means.

17. The apparatus as described in claim 16, wherein the nozzle is freely movable within the containment means.

18. A nozzle spray containment apparatus comprising:

containment means, being at least partially rigid, for containing sprayed material being applied from a nozzle to a work surface, the sprayed material being applied through an opening formed in a portion of the containment means; and adapter means, being at least partially rigid, removably mountable to the containment means adjacent the opening for adapting engagement of the containment means to said work surface for accommodating variations in the work surface, rigid portions of the adapter means and the containment means, adjacent said opening primarily conform the contour of the opening to contact and encompass the work surface along at least two distinct planes.

19. The apparatus as described in claim 18, wherein the nozzle is freely movable within the containment means.

20. An adapter apparatus for use with a containment means for containing a sprayed material being sprayed onto a contoured work surface from a nozzle within the containment means the sprayed material being applied through an opening formed in a portion of the containment means, the adapter apparatus being partially rigid and being mountable on said containment means to define said opening, the adapter apparatus having at least two non-planar configurations forming a contacting engagement with the work surface, rigid portions of the adapter apparatus defining a contour of the opening to conform the containment means to the contour of said work surface.

21. The apparatus as described in claim 20, wherein the contacting engagement is a sealing engagement.

* * * * *